US009216336B2

(12) United States Patent
Jackson

(10) Patent No.: US 9,216,336 B2
(45) Date of Patent: Dec. 22, 2015

(54) MAGNETIC GOLF TEE AND DUAL BALL MARKER COMBINATION

(71) Applicant: Christopher Travis Jackson, Mountain Grove, MO (US)

(72) Inventor: Christopher Travis Jackson, Mountain Grove, MO (US)

(73) Assignee: Christopher T. Jackson, Mountain Grove, MO (US)

( * ) Notice: Subject to any disclaimer, the term of this patent is extended or adjusted under 35 U.S.C. 154(b) by 0 days.

(21) Appl. No.: 14/145,622

(22) Filed: Dec. 31, 2013

(65) Prior Publication Data

US 2015/0182827 A1 Jul. 2, 2015

(51) Int. Cl.
*A63B 57/00* (2015.01)

(52) U.S. Cl.
CPC ..... *A63B 57/0018* (2013.01); *A63B 57/0075* (2013.01); *A63B 2209/08* (2013.01)

(58) Field of Classification Search
CPC ..... A63B 57/0018; A63B 2057/0025; A63B 57/0075; A63B 2209/08
USPC ..... 473/387–403
See application file for complete search history.

(56) References Cited

U.S. PATENT DOCUMENTS

| | | | | |
|---|---|---|---|---|
| 2,589,763 | A * | 3/1952 | Barrett | 473/391 |
| 4,114,878 | A * | 9/1978 | Hammond | 473/394 |
| 4,893,818 | A * | 1/1990 | Liccardello | 473/396 |
| 5,672,122 | A * | 9/1997 | Strong | 473/398 |
| 6,186,907 | B1 * | 2/2001 | Woodward | 473/400 |
| 6,692,383 | B1 * | 2/2004 | Heron | 473/400 |
| 7,226,370 | B1 * | 6/2007 | Cope | 473/406 |
| 2006/0100037 | A1 * | 5/2006 | Pels | 473/387 |
| 2006/0105861 | A1 * | 5/2006 | Yang | 473/396 |
| 2007/0270245 | A1 * | 11/2007 | Jung | 473/396 |
| 2008/0009372 | A1 * | 1/2008 | Lee | 473/393 |
| 2008/0039238 | A1 * | 2/2008 | Lee | 473/400 |
| 2008/0064532 | A1 * | 3/2008 | Lee | 473/396 |
| 2008/0096694 | A1 * | 4/2008 | Chang | 473/397 |
| 2013/0310200 | A1 * | 11/2013 | Nelson et al. | 473/401 |
| 2014/0100060 | A1 * | 4/2014 | Kamei | 473/406 |
| 2014/0329619 | A1 * | 11/2014 | Chang | 473/396 |

* cited by examiner

*Primary Examiner* — Steven Wong

(57) ABSTRACT

This invention includes a golf tee portion with a shaft and two ends. One end of that portion includes a ball receiving end and one end includes a cavity portion for receiving a magnetic material. There is a cylindrical ball marker portion that goes between the golf tee portion and the base and is attracted to both. Last there is a grounded cylindrical base with two ends. One end can include a stem or series of stems so it can adhere in the ground, and one end is equipped with two cavities. One cavity is larger for placing a magnetic material which is attracted to the golf tee portion, and the removable ball marker, and a smaller cavity for magnetic material so the material in the larger cavity is held but removable. This design allows less friction on golf drives, and dual usage as a ball marker on the green.

1 Claim, 4 Drawing Sheets

MAGNETIC GOLF TEE AND DUAL BALL MARKER COMBINATION

BACKGROUND OF THE INVENTION

The sport of golf includes the use of a club which is used to strike a stationary ball. A game of golf is usually played in a series of holes. Each hole may have several different characteristics, but two constant aspects are the starting point and the end point. They are commonly referred to as the tee box and the green respectively. When a player starts a hole it is common for the player to use a golf tee to elevate the ball off of the playing surface so it is more easily struck, and in an effort to make the ball go as far as possible. The players then try to reach the green in as few shots possible. Once a player has reached the green it is common for a player to use a golf ball marker to indicate his position on the green so they can clean their golf ball in accordance to the rules of golf.

SUMMARY OF THE INVENTION

The Magnetic Golf Tee and Dual Ball Marker Combination is a golf tool that can help its user in the game of golf in several different ways. The golf tee portion of the golf tool is magnetically attracted to the golf ball marker portion or the base portion of the tool, and when the ball is struck by the golf club on the tee box the magnetic attraction between the two components is instantly broken which places less friction on the golf ball and allows for the golf ball to travel greater distances.

The golf ball marker, or the base, or a combination of the two, hold the golf tee portion erect when on the tee box so the user can hit the golf ball, but they can both also be used to mark the golf balls position when the players ball reaches the green. Also where players used to carry multiple tools to do multiple jobs, the magnetic construction of the three pieces allow its user to do multiple tasks but carry the tool in one easy to handle piece.

DETAILED DESCRIPTION OF THE INVENTION

Figure 1:
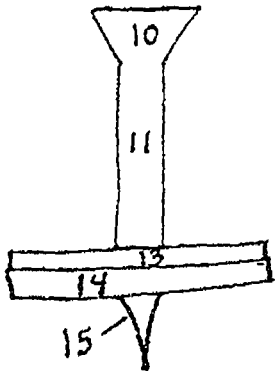
FIG. 1 is a side view of the present invention in a state where the magnetic material holds the golf tool in one piece.
Figure 2:
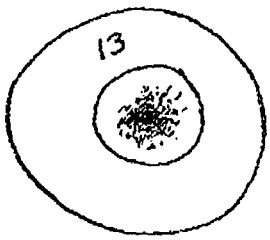
FIG. 2 is a top view of the present invention in a state where the magnetic material holds the golf tool in one piece
Figure 3:
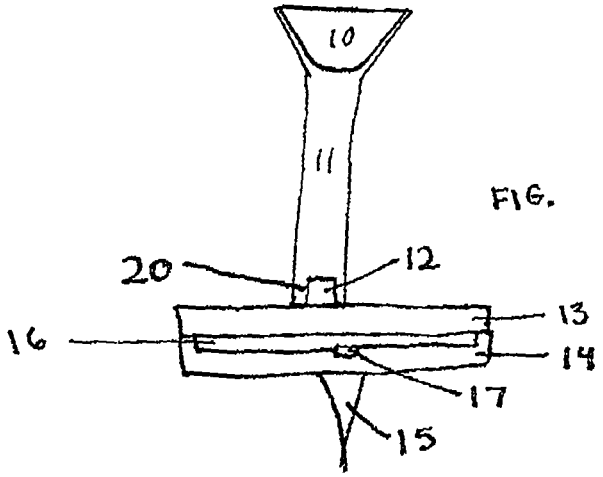
FIG. 3 is a cross sectional side view of the present invention in a state where the magnetic material holds the golf tool in one piece
Figure 4:
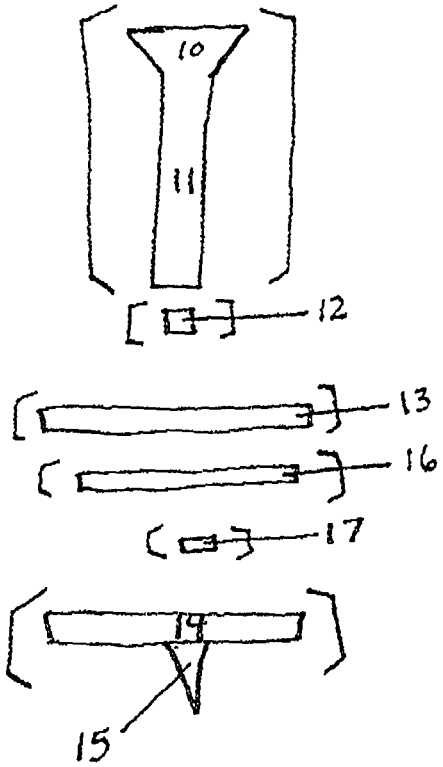
FIG. 4 is an exploded side view of the present invention
Figure 5:
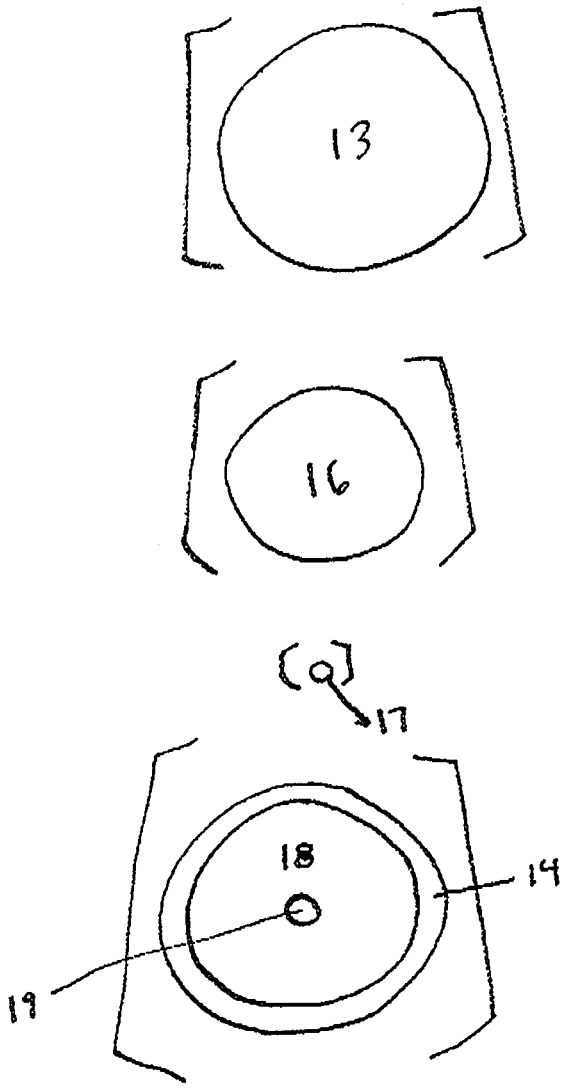
FIG. 5 is an exploded top view of the ball marker and base portion of the present invention

The nonprovisional application herein is made in reference to provisional patent application 61/748,256 filed on Jan. 2, 2013. The Magnetic Golf Tee and Dual Ball Marker Combination is a multiple use golf tool meant for use in the sport of golf. In its ideal form it is made of multiple individual pieces which comprise three main components. Whereas the traditional golf tees and golf ball markers are separate pieces, this golf tool utilizes magnets to make multiple tools into one unit that can be used in a variety of ways.

There is a golf tee portion 10,11,12,20 which includes a shaft 11 and two distinct ends. It can be made of a variety of materials and in different ways, but it seemingly works best when it is made of plastic material or nylon, and done so through the process of injection molding. The first end is a ball receiving end 10 which would enable its user to place a golf ball on the top of that end, and a second end which in its most convenient form would have a recession 20 where a magnetic material can be placed so it can be magnetically attracted to other main components of the golf tool which would be the base 14 and the golf ball marker 13. The golf tee portion 10,11,12,20 can be created in several configurations so long as there is one end with a golf ball receiving portion 10 and it is able to become magnetically attracted to the base portion 14.

The second main component to the golf tool is the removable golf ball marker 13. The marker can be made in many designs but in its optimal configuration it would be a thin cylindrical object similar to popular golf ball markers that are commonly used today, and made of a magnetic material so it can be magnetically attracted to the golf tee portion 10,11,12,20 of the golf tool and the base 14. It could be produced in a variety of ways including molding or metal stamping.

The last major component of the golf tool is the base 14. Similar to the construction of the golf tee portion 10,11,12,20 it too can be made in a variety of ways and in a variety of materials, but the best method seems to be producing the base through the process of injection molding and using some kind of plastic to create it. The base can be configured in many various shapes and sizes, but the optimal configuration of the base would be a thin cylindrical object with two different sides. The first side can be configured in a variety of ways, but it would have to be made of, or have some kind of magnetic material attached to it so that it can become magnetically attracted to the golf tee portion 10,11,12,20 and/or the ball marker portion 13. In its ideal configuration the first side would have two recessions in it of different sizes. There would be a larger recession 18 in which an insert 16 can be placed. There would also be a smaller recession 19 in which another insert 17 can be placed. Either one of these inserts can be adhered into the recession with an adhesive if it is preferred. In the ideal configuration the smaller recession 19 would have a magnetic material placed inside of it that would then be adhered into the base. The larger recession 18 would then house another magnetic material so it can be magnetically attracted to the golf tee portion 10,11,12,20 and/or the golf ball marker 13, this magnetic material can be adhered into the base 14, but would best be only magnetically attracted to the insert 17 in the smaller recession so it can be removed and used as another golf ball marker.

The insert 16 into the larger recession 18 could also be made of a non-magnetic material and an adhesive can be used to adhere it to the base 14 or it can be placed in the base 14 so that it can be removed later. In this instance the magnetic material insert 17 in the smaller recession 19 would make the magnetic attraction to the golf tee portion 10,11,12,20 or the ball marker 13 or both. The base could also be made with only one recession 18 or 19 for a magnetic material insert or the base could be made completely, or almost completely, of a magnetic material, as long as it can still be magnetically attached to the tee top.

The second side of the base portion can be flat so it lays directly on the ground, but would best be made with some sort of stem 15 or stems that come out of the second end, or are attached to it, so it can be adhered into the ground.

The invention claimed is:

1. A magnetic golf tee and golf tee base in combination with a golf ball marker, the combination comprising:

a golf tee portion having a ball receiving end-and an opposite end, the opposite end having a recession with a magnetic material placed therein:

a removable golf ball marker that is magnetically attracted to the magnetic material of the opposite end; and a base having a removable insert and a smaller insert, both inserts being made from a magnetic material, wherein the ball marker is interposed between the base and golf tee portion and the removable insert functions as an additional ball marker.

* * * * *